United States Patent [19]

Wagener et al.

[11] 4,282,066

[45] Aug. 4, 1981

[54] PROCESS AND APPARATUS FOR COKING COAL USING MICROWAVE RADIATION

[75] Inventors: Dietrich Wagener; Horst Fach; Hayri Ergun, all of Essen, Fed. Rep. of Germany

[73] Assignee: Didier Engineering GmbH, Essen, Fed. Rep. of Germany

[21] Appl. No.: 23,092

[22] Filed: Mar. 22, 1979

[30] Foreign Application Priority Data

Mar. 22, 1978 [DE] Fed. Rep. of Germany ..... 2812520

[51] Int. Cl.[3] ..... C10B 19/00; C10B 23/00

[52] U.S. Cl. ..... 201/6; 165/DIG. 6; 201/19; 201/34; 201/41; 202/99; 202/253; 202/270

[58] Field of Search ..... 201/6, 19, 32, 34, 39, 201/41; 202/96, 99, 105, 117, 120, 128, 133, 251, 252, 253, 270, 262 US, 119; 165/DIG. 6; 34/1, 4; 250/527; 219/10, 55 R, 55 M, 10.65; 422/186

[56] References Cited

U.S. PATENT DOCUMENTS

| | | | |
|---|---|---|---|
| 2,542,028 | 2/1951 | Hodge | 201/19 X |
| 2,580,700 | 1/1952 | Phillips | 202/252 X |
| 3,176,679 | 4/1965 | Langley | 165/DIG. 6 |
| 3,449,213 | 6/1969 | Knapp et al. | 201/19 |
| 3,843,457 | 10/1974 | Grannen et al. | 201/19 X |
| 4,118,282 | 10/1978 | Wallace | 201/41 X |

FOREIGN PATENT DOCUMENTS

| | | | |
|---|---|---|---|
| 17014 | 5/1907 | Norway | 201/6 |

*Primary Examiner*—Bradley Garris

*Attorney, Agent, or Firm*—Wenderoth, Lind & Ponack

[57] ABSTRACT

Coal, either as coal fines or as coal briquettes, is introduced into a coking chamber and is thereat exposed to microwave radiation to transform the coal into hot coke. Preferably, the microwave radiation is at a frequency of from twenty to 3000 MHz. The hot coke is then passed to a cooling zone whereat photocells absorb radiant energy from the hot coke and transform the thus absorbed radiant energy into electricity.

22 Claims, 9 Drawing Figures

PROCESS AND APPARATUS FOR COKING COAL USING MICROWAVE RADIATION

BACKGROUND OF THE INVENTION

The present invention relates to a process and an apparatus for transforming coal into coke, and to a raw coal briquette usable therewith.

Presently known systems for transforming coal into coke employ coke ovens of various types. In the operation of such coke ovens, the heat of combustion of combustible gases is brought to walls of internal chambers containing the coal within the coke ovens. Such systems require considerable capital investment. Furthermore, such systems are inherently dependent upon the availability of the required combustible gases. Furthermore, such systems emit substantial amounts of pollutants.

SUMMARY OF THE INVENTION

With the above discussion in mind, it is an object of the present invention to provide a novel process and apparatus for transforming coal into coke by exposing the coal to sufficient microwave radiation to achieve coking of the coal, and wherein it is possible to avoid the prior art disadvantages.

It is a further object of the present invention to provide an improved raw coal briquette which has a configuration which is particularly useful and advantageous during the transformation of the raw coal briquette into a coke briquette by being subjected to microwave radiation.

It is known to employ microwave radiation for the defrosting, heating, cooking and baking of food in restaurants and homes, for the hardening of shaped elements of solid material to which aqueous bonding agents are added, for the sintering or melting of ceramic or fire-resistant products, and for the cementing of wooden edges. On the other hand, it is known that not all kinds of materials can be heated in a desired manner with microwave radiation, since the heat developed per unit of volume and per unit of time depends on the field intensity including the operational frequency on the one hand, and on the other hand, on the dielectric constant of the material involved.

It has however surprisingly been found that coal may be transformed into coke by exposing the coal in a coking chamber to microwave radiation, particularly microwave radiation at a frequency range of from twenty to 3000 MHz.

The coal may be introduced intermittently in batches into the coking chamber. Alternatively, the coal may be continuously introduced into and passed through the coking chamber.

In accordance with a further feature of the present invention, the hot coke may be withdrawn from the coking chamber and introduced into a cooling zone, whereat the coke is at least partially cooled to form cooled coke. The coke may be intermittently introduced into the cooling zone in batches, or alternatively the coke may be continuously introduced into and passed through the cooling zone. In accordance with a specifically preferred feature of the present invention, the hot coke is cooled in the cooling zone by exposing photocells to the hot coke. The photocells thereby absorb radiant energy from the coke and transform the absorbed radiant energy into electricity. For example, an artificial cesium (Cs) coating may be employed for absorption and transformed of kinetic energy from streams or rays of heat and rays of nonvisible light (for example infrared light) into an electrical current. Since the rays emitted from the coke remain in a fixed dependent relationship with the temperature, the absorption and transformation of the radiant energy quickly reduces the intensity of reflection and convection of the heat within the coke, and this leads to an even further advanced cooling of the coke. Thus, electrical energy may be recovered from the hot coke, and the absorption of radiant energy results in a quick reduction of the intensity of reflection and convection within the cooling zone.

The coal may be in the form of coal fines positioned within a coking chamber having a square cross-section. Alternatively, the coal may be in the form of briquettes which may be square-shaped or egg-shaped. Even further, the raw coal briquette may be in the form of a cylindrical or ball-shaped body having a hole extending therethrough.

The coking chamber may be designed as a waveguide or as a cavity or chamber resonator.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
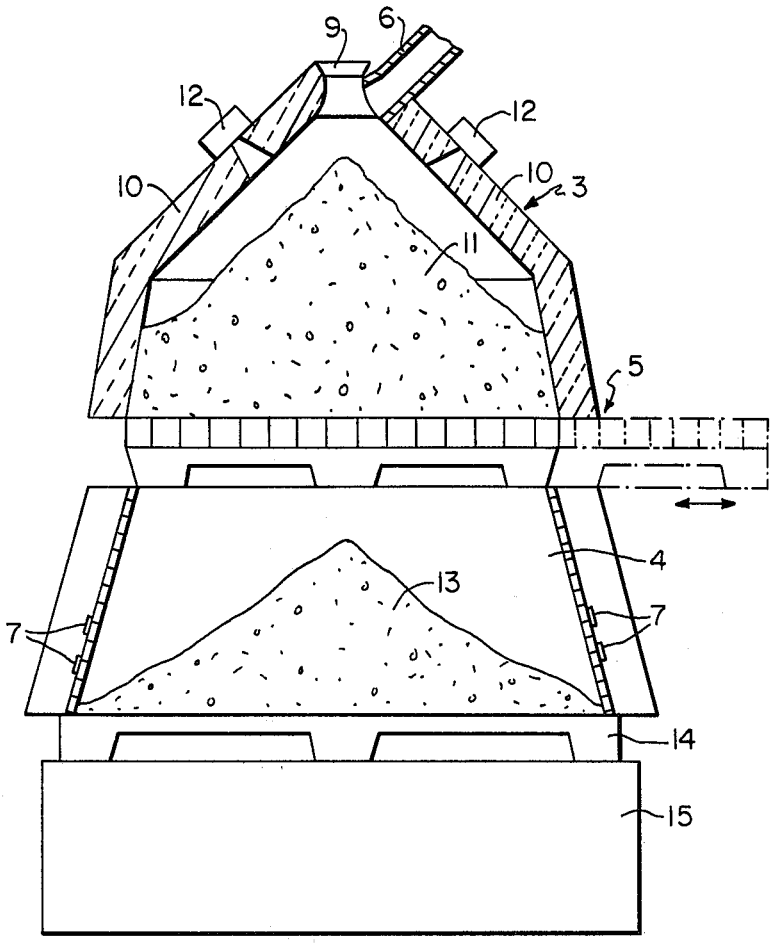
FIG. 1 is a schematic cross-sectional view of a first embodiment of the present invention.

With reference now to FIG. 1, a first embodiment of the present invention will be described. A coking chamber 3 is generally cap-shaped or hood-shaped and has an open bottom, sloping upper walls 10, an upper charging or filling opening 9, and a gas flue 6. Beneath the coking chamber 3 is a closure element 5 which is movable between a closed position (shown in solid lines in FIG. 1) whereat the bottom of coking chamber 3 is closed, and an open position (shown in dashed lines in FIG. 1) wherein the bottom of coking chamber 3 is opened.

Beneath closure element 5 is a cooling zone 4, on the inner walls of which are positioned photocells 7 to absorb radiant energy. Beneath cooling zone 4 is a bottom closure 14 for transferring coal into a transport container 15.

During operation of the device of FIG. 1, a charge of coal 11 to be coked is introduced through filling opening 9 into coking chamber 3, which in this embodiment is designed as a cavity or chamber resonator. The coal charge 11 piles up on closure element 5, and during filling, the upper surface of the coal charge 11 will adjust itself to be approximately parallel to the sloping walls 10, as is generally shown in FIG. 1. Filling opening 9 is then closed, and microwave generators 12 are operated so that the coal charge 11 is exposed to sufficient microwave radiation, preferably at a frequency of from twenty to 3000 MHz, to transform the coal charge into hot coke. Gases that are produced during this transformation are removed by way of gas flue 6.

After the completion of the coking operation, closure element 5 is moved to the open position, such that the hot coke 13 falls into the cooling zone 4. The photocells 7 absorb radiant energy from the coke, thereby at least partially cooling the coke and also reducing the intensity of reflection and convection within the cooling zone 4. The bottom closure 14 is then actuated to allow the thus cooled coke to drop from cooling zone 4 into transport container 15.

Figure 2:
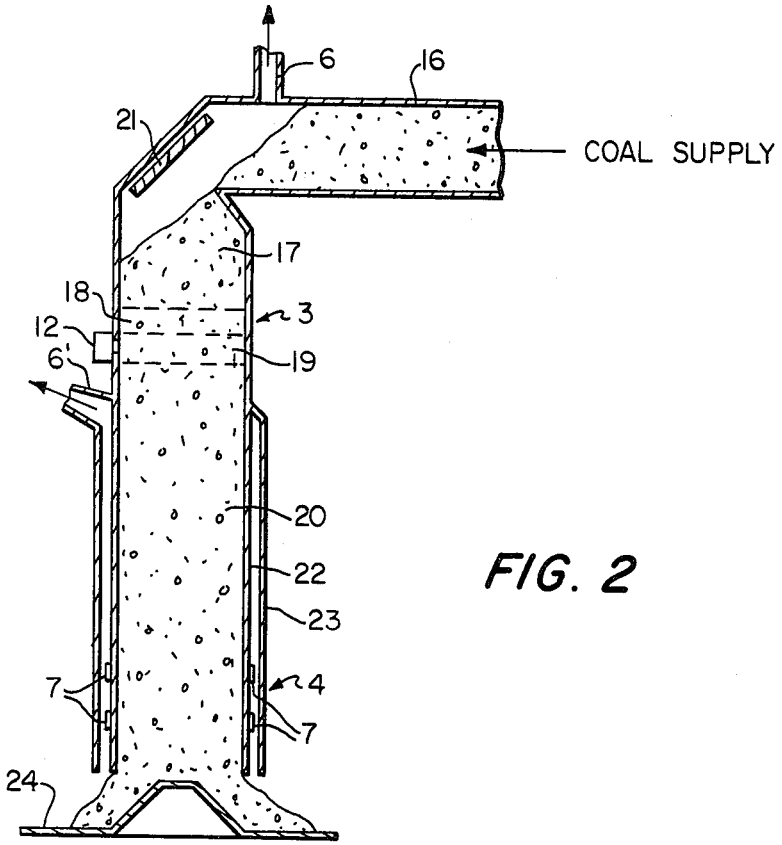
FIG. 2 is a schematic cross-sectional view of a second embodiment of the present invention.

With reference now to FIG. 2 of the drawings, a further embodiment of the present invention will be discussed. In this arrangement, coking chamber 3 and cooling zone 4 are generally formed of a vertical continuous shaft. Coal is supplied to the shaft by means of a horizontal channel 16. The coking chamber 3 generally includes a heating zone 17, a fusion zone 18, a setting zone 19 and a hardening zone 20. During these zones the coal is exposed to microwave radiation to transform the coal into hot coke. The channel 16 is joined to the vertical coking chamber 3 by an inclined joint which may include a head radiator 21 to dry and preheat the coal. Resultant liberated miosture and gases are removed through gas flue 6.

The lower area of the coking chamber 3, including the hardening zone 20, is formed of walls 22 in the form of grates having a sufficient mesh size to allow the expulsion of gas. Walls 22 are surrounded by continuous housing walls 23. A further gas flue 6' removes the liberated gas from the space between walls 22 and 23.

The coking chamber 3 directly transforms into cooling zone 4 the inner walls of which may be provided with photocells 7 to absorb radiant energy from the hot coke and to thus cool the coke. The at least partially cooled coke is discharged from the bottom of cooling zone 4 by a revolving plate discharge 24. The continuous operating speed of the coking chamber is controlled by the speed of coal supply to channel 16 and the discharge speed of revolving plate 24.

Figure 3:
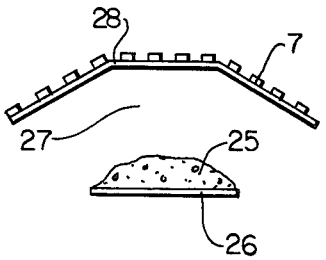
FIG. 3 is a transverse cross-sectional view of a modification of a portion of FIG. 2.

FIG. 3 shows a slight modification of the embodiment of FIG. 2, wherein the vertical cooling zone 4 of FIG. 2 may be replaced by a horizontal platform conveyor 26 which conveys coke 25 through a horizontal channel 27 defined by a cover 28 provided with photocells 7.

Figure 4:
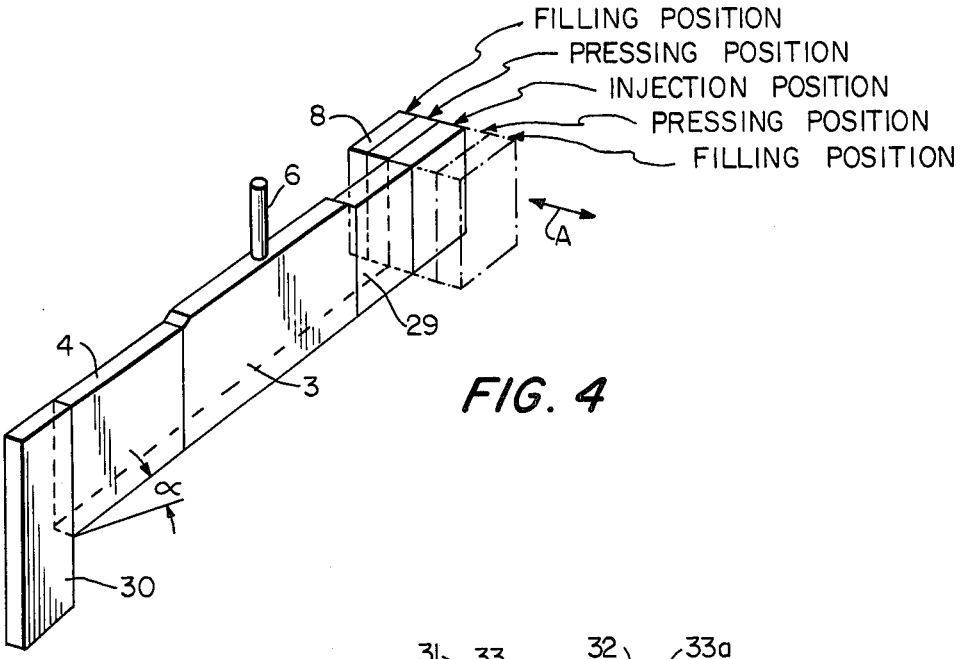
FIG. 4 is a schematic perspective view of a third embodiment of the present invention.

With reference now to FIG. 4 of the drawings, a third embodiment of the present invention will be discussed. In this embodiment, a magazine-like element includes at least one filling chamber 8. The magazine-like element is movable in the directions shown by arrow A such that each filling chamber 8 is positioned at a filling position, at a pressing position, or at an injection position. At the filling position, the filling chamber 8 is filled with coal. At the pressing position, the filled coal, preferably coal fines, is compressed. In the injection position, the filling chamber 8 aligns with and is pushed into (for example by a pusher, not shown) a preheating zone and gas trap 29. This injection causes the transfer of coal previously positioned in zone 29 into coking chamber 3. By this manner of injection, the coal is advanced through coking chamber 3 whereat the coal is exposed to microwave radiation and is transformed into hot coke. The hot coke is thereby transferred into a cooling zone 4 which is supplied with photocells to cool the coke. Coking chamber 3 has a gas flue 6 to remove gases. From cooling zone 4, the cooled coke is transferred to an outlet 30 which may include a gas trap. In order to facilitate movement of the coal throughout the system shown in FIG. 4, the zone 29, the coking chamber 3 and the cooling zone 4 are in the form of a channel inclined at an angle $\alpha$ to the horizontal.

Figure 5A:
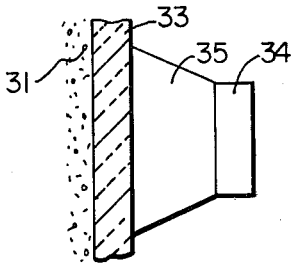
FIGS. 5*a* and 5*b* are partial schematic cross-sectional views of the walls of the coking oven according to the present invention.
Figure 5B:
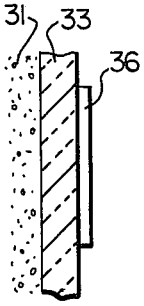

FIGS. 5*a* and 5*b* schematically show two ways in which the coal to be coked may be exposed to microwave radiation. In FIG. 5*a*, coal 31 to be coked is adjacent a wall 33 which may be a layer of ceramic insulation material. A magnitron or klystron 34 with a resonance space 35 is attached to the outer wall surface of wall 33. In FIG. 5*b*, microwave radiation is supplied to coal 31 to be coked by means of electrodes 36 positioned on the outer surface of wall 33. It is to be understood that it is intended to be within the scope of the present invention that coal to be coked within the coking chamber be exposed to microwave radiation in any otherwise known manner in accordance with microwave technology.

Figure 5C:
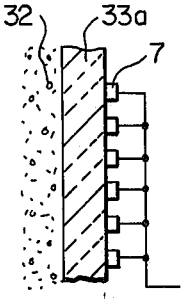
FIG. 5*c* is an enlarged schematic cross-sectional view of a portion of a wall of a cooling zone of the present invention.

FIG. 5*c* illustrates coke 32 adjacent a wall 33*a* of cooling zone 4. Wall 33*a* may be a layer of ceramic material. On the exterior surface of wall 33*a* are located a plurality of photocells 7 which may be any known type of photocell unit capable of absorbing radiant energy and transforming the thus absorbed radiant energy into electrical energy, as is schematically shown. Filter glass may be inserted between the hot coke 32 and the photocells in the various embodiments of the invention.

Figure 6A:
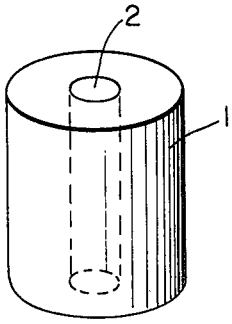
FIGS. 6*a* and 6*b* are schematic perspective views of briquettes according to the present invention.
Figure 6B:
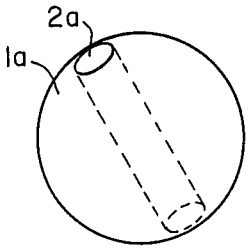

In accordance with a further feature of the present invention, a raw coal briquette may include a cylindrically shaped body of coal 1 having a hole 2 therethrough, as shown in FIG. 6*a*, or a ball-shaped body 1*a* of coal having extending therethrough a hole 2*a*, as shown in FIG. 6*b*. This briquette configuration is particularly desirable when transforming coal into coke by microwave radiation. The central hole 2 or 2*a* serves the purpose of avoiding an interior softened area that would permit deformation of the briquettes during coking. Also, the central hole permits distillation gases which develop during the coking operation to escape through a larger surface area and thus avoiding an excessive internal pressure within the birquette.

Although the present invention has been described above and has been illustrated with regard to certain specific structural and operational features, it is to be understood that various modifications may be made thereto without departing from the scope of the present invention. Specifically, the configurations of the coking chambers and cooling zones may be other than as specifically illustrated. It is of course to be understood that the various structures of the present invention will in all cases be designed in accordance with known concepts to provide an operationally safe structure whereby leakage of microwave energy is prevented. It is further to be understood that the microwave energy source may be any conventional and known source and may be operatively connected to the coking chamber in any conventional and known manner, to achieve a microwave radiation sufficient to transform the coal into coke. It is also to be understood that the coking chamber may be designed in accordance with known concepts as a waveguide or as a cavity or chamber resonator.

What we claim is:

1. A process for coking coal, said process comprising:
introducing coal to be coked into a coking chamber;
exposing said coal within said coking chamber to microwave radiation only, and thereby forming said coal into hot coke; and
withdrawing said hot coke from said coking chamber, introducting said hot coke into a cooling zone, and at least partially cooling said hot coke within said cooling zone to form cooled coke, said cooling comprising exposing photocells to said hot coke, whereby said photocells absorb radiant energy from said coke and transform the thus absorbed radiant energy into electricity.

2. A process as claimed in claim 1, wherein said microwave radiation is at a frequency of from 20 to 3000 MHz.

3. A process as claimed in claim 1, wherein said coal is introduced intermittently in batches into said coking chamber.

4. A process as claimed in claim 1, wherein said coal is continuously introduced into said coking chamber and continuously passed therethrough.

5. A process as claimed in claim 1, wherein said coke is continuously introduced into and passed through said cooling zone.

6. A process as claimed in claim 1, wherein said coke is introduced intermittently in batches into said cooling zone.

7. A process as claimed in claim 1, wherein said coking chamber has a square cross-section, and said coal to be coked comprises coal fines.

8. A process as claimed in claim 1, wherein said coal to be coked comprises coal briquettes.

9. An apparatus for coking coal, said apparatus comprising:
a coking chamber;
means for introducing coal to be coked into said coking chamber;
means operatively associated with said coking chamber for exposing said coal within said coking chamber to microwave radiation only and for thereby forming said coal into hot coke;
a cooling zone adjacent said coking chamber, whereby said hot coke passes from said coking chamber to said cooling zone; and
means at said cooling zone for at least partially cooling said hot coke to form cooled coke, said cooling means comprising photocell means for absorbing radiant energy from said hot coke and for transforming said radiant energy into electricity.

10. An apparatus as claimed in claim 9, wherein said exposing means comprises means for generating microwave radiation at a frequency of from 20 to 3000 MHz.

11. An apparatus as claimed in claim 9, wherein said coking chamber comprises a waveguide.

12. An apparatus as claimed in claim 9, wherein said coking chamber comprises a cavity or chamber resonator.

13. An apparatus as claimed in claim 9, wherein said introducing means comprises means for charging said coal intermittently in batches into said coking chamber.

14. An apparatus as claimed in claim 9, wherein said introducing means comprises means for continuously supplying coal to and passing said coal through said coking chamber.

15. An apparatus as claimed in claim 9, wherein said coking chamber comprises a hood-shaped member with an open bottom, said introducing means comprises a charging opening in the top of said member, said cooling zone is positioned beneath said member, and further comprising a closure element movable between a first position closing said bottom of said member and a second position opening said bottom of said member, whereby upon movement of said closure element to said second position, said hot coke will drop through said open bottom into said cooling zone.

16. An apparatus as claimed in claim 9, wherein said coking chamber and said cooling zone comprise a continuous shaft.

17. An apparatus as claimed in claim 16, wherein said shaft extends substantially vertically and has a square transverse cross-section, and said coking chamber is positioned above said cooling zone.

18. An apparatus as claimed in claim 17, wherein said introducing means comprises a substantially horizontal channel member having a square transverse cross-section and connected to the upper end of said shaft.

19. An apparatus as claimed in claim 16, wherein said shaft is inclined to the horizontal, and said introducing means comprises a filling chamber having a transverse cross-section equal to that of said shaft, said filling chamber being movable in directions transverse to the direction of movement of said coal into said shaft between a filling position out of alignment with said shaft, a pressing position out of alignment with said shaft, and an injection position in alignment with said shaft.

20. An apparatus as claimed in claim 16, further comprising a magazine-like member having a plurality of said filling chambers.

21. An apparatus as claimed in claim 9, wherein said photocell means are mounted on inner walls of said cooling zone.

22. An apparatus as claimed in claim 9, wherein said coking chamber includes flue means for discharging gases.

* * * * *